US011409211B2

(12) United States Patent
Nedelin et al.

(10) Patent No.: US 11,409,211 B2
(45) Date of Patent: Aug. 9, 2022

(54) BLANKET MEMORY ARTIFACT REDUCTION

(71) Applicant: HP INDIGO B.V., Amstelveen (NL)

(72) Inventors: Peter Nedelin, Ness Ziona (IL); Mark Sandler, Ness Ziona (IL); Shai Lior, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 17/066,064

(22) Filed: Oct. 8, 2020

(65) Prior Publication Data

US 2021/0026278 A1 Jan. 28, 2021

Related U.S. Application Data

(63) Continuation of application No. 16/485,516, filed as application No. PCT/EP2017/054814 on Mar. 1, 2017, now Pat. No. 10,802,422.

(51) Int. Cl.
*G03G 15/16* (2006.01)
*G03G 15/00* (2006.01)

(52) U.S. Cl.
CPC ..... *G03G 15/161* (2013.01); *G03G 15/5066* (2013.01)

(58) Field of Classification Search
CPC ..... G03G 15/161; G03G 15/10; G03G 15/11; G03G 15/1605
See application file for complete search history.

(56) References Cited

U.S. PATENT DOCUMENTS

| | | | | |
|---|---|---|---|---|
| 5,978,631 | A | 11/1999 | Lee | |
| 6,466,756 | B1 | 10/2002 | Nakashima et al. | |
| 7,233,762 | B2 * | 6/2007 | Kunii | G03G 15/169 399/307 |
| 8,185,020 | B2 * | 5/2012 | Yoshie | G03G 15/11 430/108.1 |
| 2002/0146258 | A1 * | 10/2002 | Iida | G03G 9/0821 399/307 |
| 2005/0025534 | A1 * | 2/2005 | Fujita | G03G 15/1665 399/307 |
| 2005/0179721 | A1 | 8/2005 | Jones et al. | |
| 2011/0058867 | A1 * | 3/2011 | Kodera | G03G 15/2007 399/335 |

(Continued)

FOREIGN PATENT DOCUMENTS

| | | | | |
|---|---|---|---|---|
| EP | 0848304 | A2 * | 6/1998 | G03G 15/161 |
| JP | 2004066804 | | 3/2004 | |

(Continued)

*Primary Examiner* — Jessica L Eley
(74) *Attorney, Agent, or Firm* — HP Inc. Patent Department

(57) ABSTRACT

In one example of the disclosure, a first transfer of ink is made from a photoconductor to a blanket in contact with the photoconductor. The blanket is to cycle along a path. The first transfer occurs at a first arc of the blanket path. A second transfer of the ink is made from the blanket to a media in contact with the blanket. The second transfer occurs at a second arc of the blanket path. A heat source located adjacent to a third arc of the blanket path is utilized to heat an external surface of the blanket. The heating is to occur following the second transfer of the ink.

20 Claims, 7 Drawing Sheets

(56) References Cited

U.S. PATENT DOCUMENTS

| | | | | |
|---|---|---|---|---|
| 2012/0093544 | A1* | 4/2012 | Sandler ..... | G03G 15/162<br>399/297 |
| 2015/0165758 | A1 | 6/2015 | Sambhy et al. | |
| 2015/0273817 | A1 | 10/2015 | Qi et al. | |

FOREIGN PATENT DOCUMENTS

| | | |
|---|---|---|
| JP | 2006218721 | 8/2006 |
| JP | 2009190366 | 8/2009 |
| KR | 100413689 | 5/2003 |
| WO | WO-2016041598 | 3/2016 |
| WO | WO-2017016599 | 2/2017 |

* cited by examiner

BLANKET MEMORY ARTIFACT REDUCTION

CROSS-REFERENCE TO RELATED APPLICATIONS

This application is a Continuation of U.S. application Ser. No. 16/485,516, filed Aug. 13, 2019, which is a U.S. National Stage Application of International Application No. PCT/EP2017/054814, filed Mar. 1, 2017, each of which is incorporated herein by reference.

BACKGROUND

A printer may apply print agents to a paper or another substrate. One example of a printer is a Liquid Electro-Photographic ("LEP") printer, which may be used to print using a fluid print agent such as an electrostatic printing fluid. Such electrostatic printing fluid includes electrostatically charged or chargeable particles (for example, resin or toner particles which may be colorant particles) dispersed or suspended in a carrier fluid).

DRAWINGS

DETAILED DESCRIPTION

Figure 1:
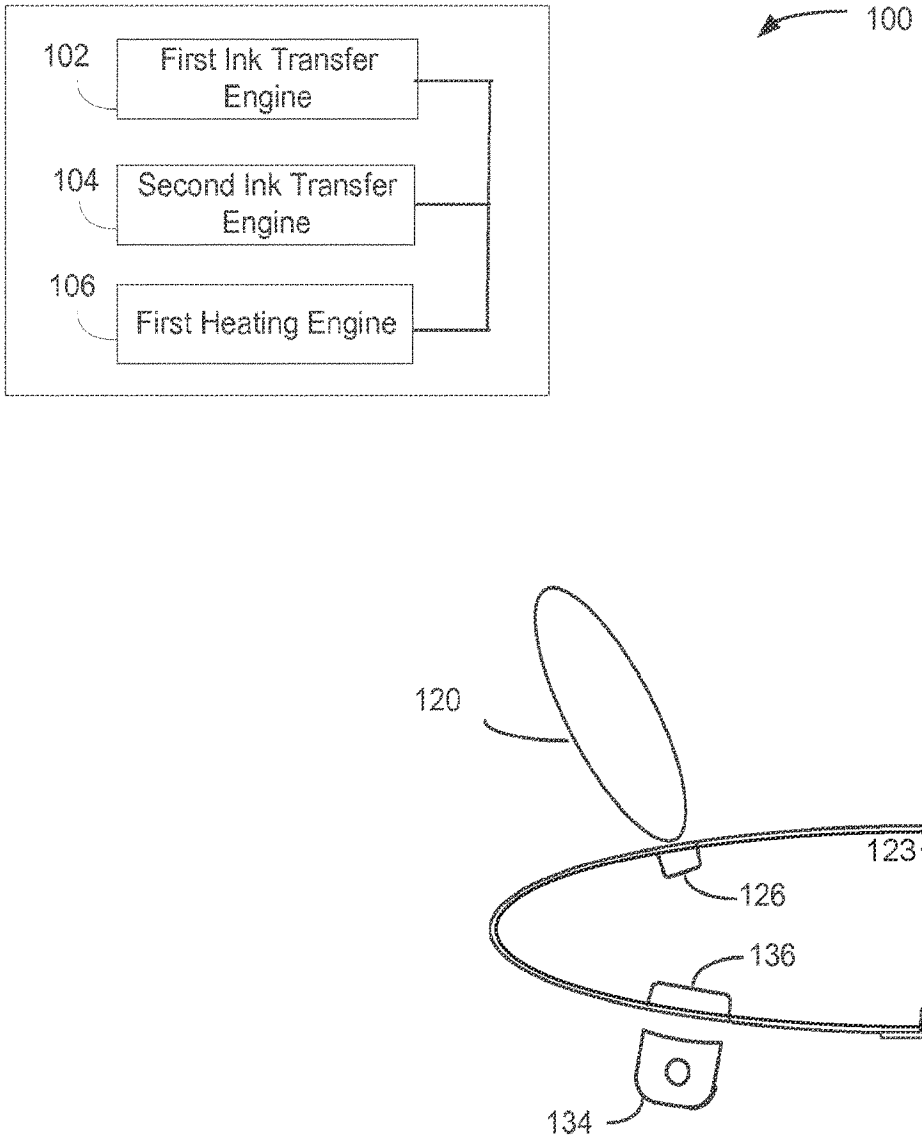
FIG. 1 illustrates an example of a system for reducing memory artifacts in a blanket during printing.

In an example of LEP printing, a printing device may form an image on a print substrate by placing an electrostatic charge on a photoconductor, and then utilizing a laser scanning unit to apply an electrostatic pattern of the desired image on the photoconductor to selectively discharge the photoconductor. The selective discharging forms a latent electrostatic image on the photoconductor. The printing device includes a development station to develop the latent image into a visible image by applying a thin layer of electrostatic ink (which may be generally referred to as "LEP ink", or "electronic ink" in some examples) to the patterned photoconductor. Charged toner particles in the LEP ink adhere to the electrostatic pattern on the photoconductor to form a liquid ink image. The liquid ink image, including colorant particles and carrier fluid, is transferred from the photoconductor to an intermediate transfer member (referred herein as a "blanket"). The blanket is heated until carrier fluid evaporates and colorant particles melt, and a resulting molten film representative of the image is then applied to the surface of the print substrate via pressure and tackiness.

For printing with colored inks, the printing device may include a separate development station for each of the various colored inks. There are typically two process methods for transferring a colored image from the photoreceptor to the substrate. One method is a multi-shot process method in which the process described in the preceding paragraph is repeated a distinct printing separation for each color, and each color is transferred sequentially in distinct passes from the blanket to the substrate until a full image is achieved. With multi-shot printing, for each separation a molten film (with one color) is applied to the surface of the print substrate. A second method is a one-shot process in which multiple color separations are acquired on the blanket via multiple applications (each with one color) of liquid ink in from the photoconductor to the blanket, and then the acquired color separations are transferred in one pass from the blanket to the substrate.

In certain examples of LEP printing the blanket can be heated to improve transferability of the developed image. For slower speed systems, the blanket may heated internally and operate without any drying systems. In these systems the heat of the blanket can dry the image and remove carrier fluid in liquid ink image to improve the transfer of the image to the substrate. For high speed imaging, a dryer system is can be used to hasten evaporation of the carrier fluid and the melting of the colorant particles to form the molten film. Typically, the dryer system will includes fans connected to air knives along the blanket circumference and will blow heated air towards the liquid ink image on the blanket. The applied heated air facilitates removing carrier fluid, e.g. by evaporation, for drying the liquid ink image prior to transferring the image to the substrate.

A significant challenge in blanket heating systems is to complete the evacuation of the liquid carrier from the blanket after the transfer of the molten film from the blanket to the media. Prior to the transfer, the film blocks a portion of the liquid carrier that lays below that film from being evaporated. And as commonly the media will be at or near an ambient temperature, immediately after the ink transfer from the blanket to the media the blanket surface temperature will drop to a level that is too low to ensure proper evaporation of the liquid carrier that was below the film. If not removed, the remaining liquid carrier may disturb the proper blanket functionality, e.g. causing print quality defect called short term memory, sometimes observed as a ghost of previously printed image. Heating the blanket to a point that would permit liquid carrier evaporation even with owing for temperature loss upon contact with the blanket is a possibility, but damage to the blanket is a concern.

In some systems, evacuation of the liquid carrier in this environment may be accomplished by exposing the blanket to intensive ventilation after the molten film is transferred to media. The intensive ventilation is to compensate for a lack of high temperature after the transfer to the media. Intensive ventilation systems can be very expensive, however, with costs including purchase price, space requirements, operating expense, and maintenance expense for the fans and conduits associated with such systems.

To address these issues, various examples described in more detail below provide a system and a method that enables reduction of blanket memory artifacts. In one example, a first transfer of ink is made from a photoconductor to a blanket in contact with the photoconductor. The blanket is to cycle along a path, and the first transfer is to occur at a first arc of the blanket path. A second transfer of the ink is made from the blanket to a media in contact with the blanket. The second transfer occurs at a second arc of the blanket path. A heat source located adjacent to a third arc of the blanket path is utilized to heat an external surface of the blanket. The heating is to occur following the second transfer of the ink.

In this manner the disclosed apparatus and method should significantly reduce memory artifacts associated with a blanket reduction by quickly and efficiently applying heat when needed at a third arc of a blanket path, without the need for an intensive ventilation system. Users of LEP printing systems will enjoy the printed image quality, energy savings, and consumables life extension made possible by the disclosed blanket memory artifact reduction apparatus and method. Installations and utilization of LEP printers should thereby be enhanced.

FIGS. 1-4 depict examples of physical and logical components for implementing various examples. In FIGS. 1-4 various components are identified as engines 102, 104, 106, 108, and 110. In describing engines 102-110 focus is on each engine's designated function. However, the term engine, as used herein, refers generally to hardware and/or programming to perform a designated function. As is illustrated later with respect to FIG. 6, the hardware of each engine, for example, may include one or both of a processor and a memory, while the programming may be code stored on that memory and executable by the processor to perform the designated function.

Figure 2:
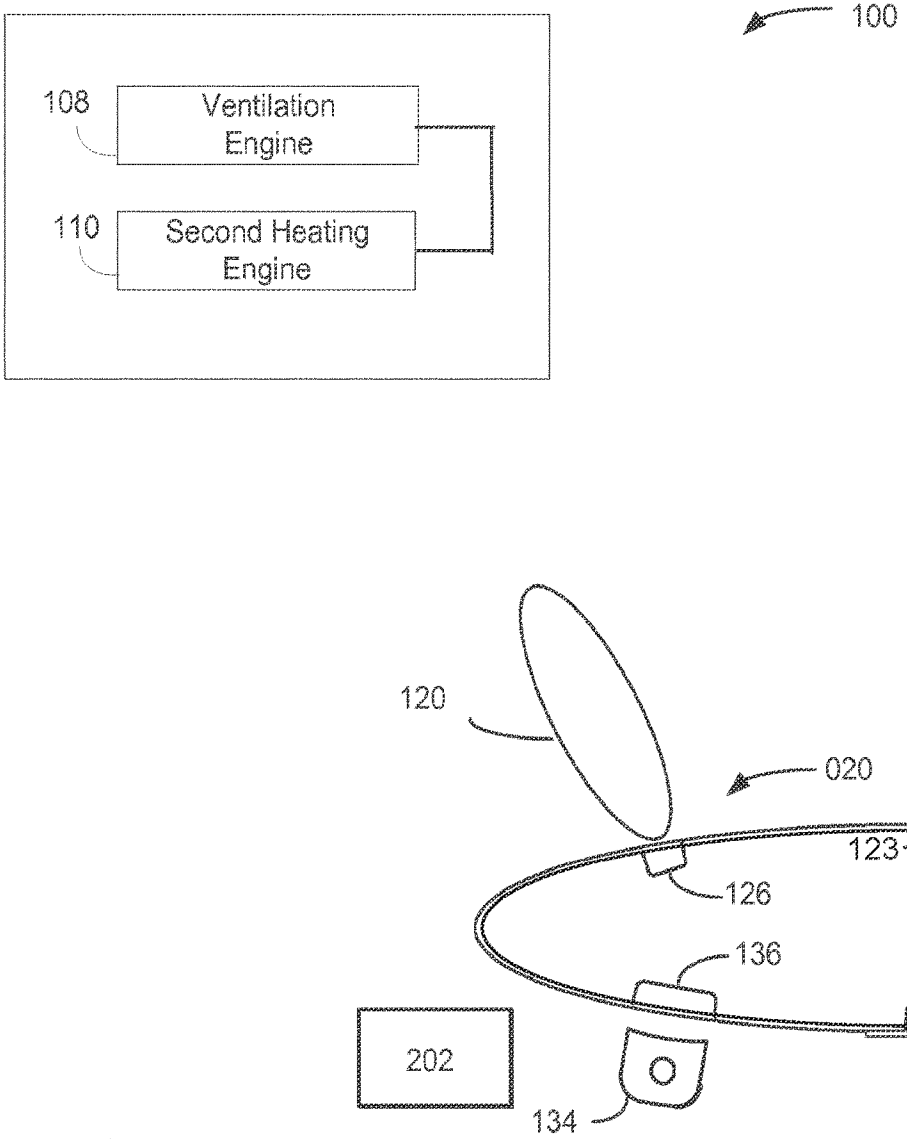
FIG. 2 illustrates another example of a system for reducing memory artifacts in a blanket during printing.

FIGS. 1 and 2 illustrate examples of a system 100 for reducing memory artifacts in a blanket during printing. In these examples, system 100 includes a first ink transfer engine 102, second ink transfer engine 104, and a first heating engine 106. Certain examples may include a ventilation engine 108 and/or a second heating engine 110. In performing their respective functions, engines 102-110 may access a data repository, e.g., a memory accessible to system 100 that can be used to store and retrieve data.

In an example, first ink transfer engine 102 represents generally a combination of hardware and programming to cause a first transfer of ink from a photoconductor 120 to a blanket 122 that is in contact with the photoconductor 120. The blanket 122 is to cycle along a path 020 in a path direction 128 and the first transfer of ink is caused to occur at a first arc 126 of the blanket path 020. As used herein, to "cycle" refers generally to move in a repeatable course. In examples a repeatable course may be a course determined by a length or course of a belt. In examples the belt may be a continuous belt. In other examples, a repeatable course may be determined by rotation of a drum or other cylinder. In examples, the photoconductor may be a photoconductor drum, a photoconductor belt, a photoconductor plate, or any other form of photoconductor. In examples, the blanket 122 may be situated upon a flexible belt 123, or other belt, and the blanket path may be, or may be determined by, a belt path.

Second ink transfer engine 104 represents generally a combination of hardware and programming to making a second transfer of the ink from the blanket 122 to a media 022 in contact with the blanket 122. In examples, media 022 may be a sheet media and the second transfer is caused to occur at a second arc 132 of the blanket path. In other examples, the media may be a media situated upon a rotating media drum or upon a belt.

First heating engine 106 represents generally a combination of hardware and programming to utilize a heat source 134 located adjacent to a third arc 136 of the blanket path 020 to heat an external surface of the blanket 122. While this disclosure frequently refers to a heat source 134, it should be noted that heat source 134 is not limited to a single component and may comprise multiple heat source components (e.g., multiple laser emitters, multiple infrared lamps, etc.). Heating of the external surface of the blanket 122 is to occur following the second transfer of the ink at the second arc 132, and before the blanket 122 returns to the first arc 126 for a new transfer of ink from the photoconductor 120.

In a particular example, the blanket 122 includes an external surface area of approximately 1 μm to 10 μm, and first heating engine 106 caused the heat source 134 to heat the external surface to a peak temperature of about 90° C. to 160° C. Such heating is focused on the external surface. For example, in some implementations after first heating engine 106 causes the heat source to activate (raising the external surface to between 90° C. to 160° C.), portions of the blanket 122 other than the external surface remain below 60° C.

In some examples, first heating engine 106 utilizes a laser emitter as the heat source 134. In these examples, the laser emitter is located adjacent to the third arc 136 of the blanket path 020 and to heat the external surface of the blanket 122 following the second transfer of the ink. The laser emitter is to emit a burst of light energy to rapidly heat the external surface of the blanket 122 to about 90° C. to 160° C. In certain examples, the rapid heating is accomplished with a burst of light energy lasting less than five milliseconds. In certain examples, the laser emitter may have a power density of between 0.5 and 5 W/mm$^2$. In certain examples, the laser emitter may emit light energy at wavelengths between 700 nm to 1μ, and may have a power consumption of less than 10 W per millimeter of printing width as the light energy is emitted to the blanket 122.

Moving to FIG. 2, in a particular example, system 100 may include a ventilation engine 108. Ventilation engine 108 represents generally a combination of hardware and programming to cause a ventilation component 202 to provide blanket ventilation in the area of the third arc 136 with a flow of about 1 to 100 liters per second. In this manner ventilation air flow as compared to existing systems for evaporating carrier fluids may be reduced by fifty percent or more.

Continuing at FIG. 2, in a particular example, system 100 may include a second heating engine 110. Second heating engine 110 represents generally a combination of hardware and programming to initiate a set of heating sources 204 located at a fourth arc 206 of the blanket path 020 to heat the external surface of the blanket 122 to about 120° C. to 200° C. Such heating by the set of heating sources 204 is to occur following the first transfer of the ink from the photoconductor 120 to the blanket 122 at the first arc 126 of the blanket path 020, and before a second transfer of the ink from the blanket 122 to the media at a second arc 132 of the blanket path 020. Thus, according to the direction 128 of the blanket path 020, the fourth arc 206 location for the set of heating devices 204 is a location in the blanket path 020 that follows the first arc 126 (where ink is applied from the photoconductor 120 to the blanket 122) and precedes the second arc 132 (where ink is applied from the blanket 122 to the media) and the third arc 136 (where the first heating element applies heat to the blanket after the transfer of the molten film to the media). In the example of FIG. 2, the set of heating sources 204 includes three distinct heating units. In other examples, set of heating units may comprise a single heating unit, two heating units, or more than three heating units. In some examples the set of heating sources may include infrared lamps, laser emitters, or any other heating source.

Figure 3:
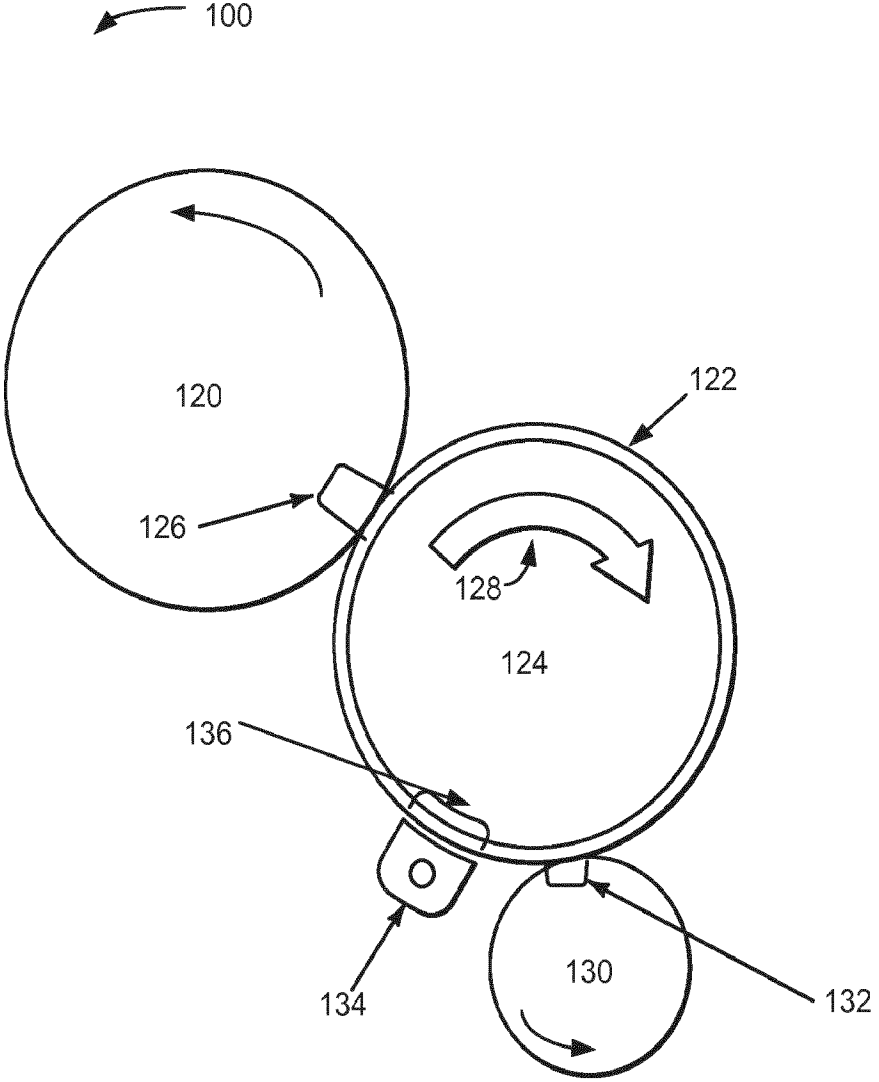
FIGS. 3 and 4 illustrate examples of a system for reducing memory artifacts in a blanket during printing, wherein the photoconductor is a rotating photoconductor drum and the blanket is situated upon a rotating blanket drum.
Figure 3:
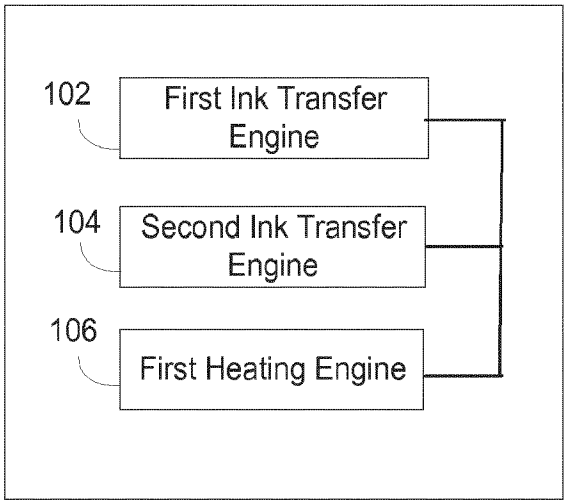
Figure 4:
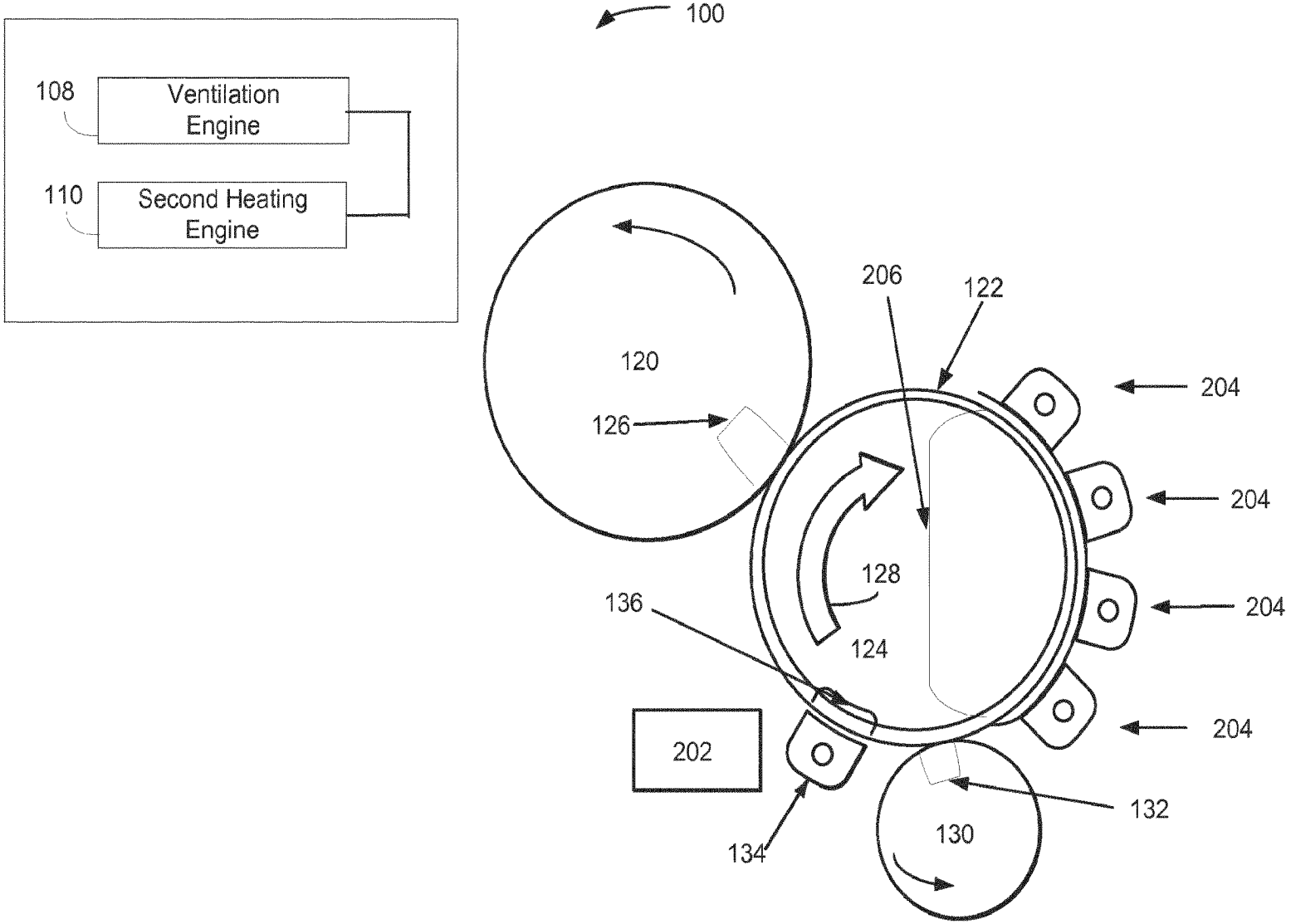

FIGS. 3 and 4 illustrate additional examples of a system for reducing memory artifacts in a blanket during printing, wherein the photoconductor is a rotating photoconductor drum and the blanket is situated upon a rotating blanket drum. In the example of FIG. 3, first ink transfer engine 102 represents generally a combination of hardware and programming to cause a first transfer of ink from a photoconductor 120 to a blanket 122 that is in contact with the photoconductor 120. The blanket 122 is situated upon a rotating blanket drum 124 and the first transfer of ink is caused to occur at a first arc 126 of a path direction 128 for the blanket drum 124.

In the example of FIG. 3, second ink transfer engine 104 causes a second transfer of the ink from the blanket 122 to a media (not visible in FIG. 3) in contact with the blanket 122. The media is situated upon a rotating media drum 130 and the second transfer is caused to occur at a second arc 132 of the blanket drum rotation path.

Continuing with the example of FIG. 3, first heating engine 106 utilizes a heat source 134 located adjacent to a third arc 136 of the rotation path 128 to heat an external surface of the blanket 122. Heating of the external surface of the blanket 122 is to occur following the second transfer of the ink at the second arc 132, and before the blanket drum 128 returns to the first arc 126 for a new transfer of ink from the rotating photoconductor drum 120.

Moving to FIG. 4, in an example, system 100 includes ventilation engine 108 and second heating engine 110. Ventilation engine 108 is to cause a ventilation component 202 to provide blanket ventilation in the area of the third arc 136 with a flow of about 1 to 100 liters per second. Second heating engine 110 is to cause a set of heating sources 204 located at a fourth arc 206 of the blanket drum rotation path 128 to heat the external surface of the blanket 122 to about 120° C. to 200° C. Such heating by the set of heating sources 204 is to occur following the first transfer of the ink from the photoconductor drum 120 to the blanket 122 at the first arc 126 of the blanket drum rotation path 126, and before a second transfer of the ink from the blanket 122 to the media at a second the 132 of the blanket drum rotation 128. In the example of FIG. 2, the set of heating sources 204 includes five distinct heating units. In other examples, set of heating units may comprise a single heating unit, two heating units, three heating units, or more than five heating units.

Figure 5:
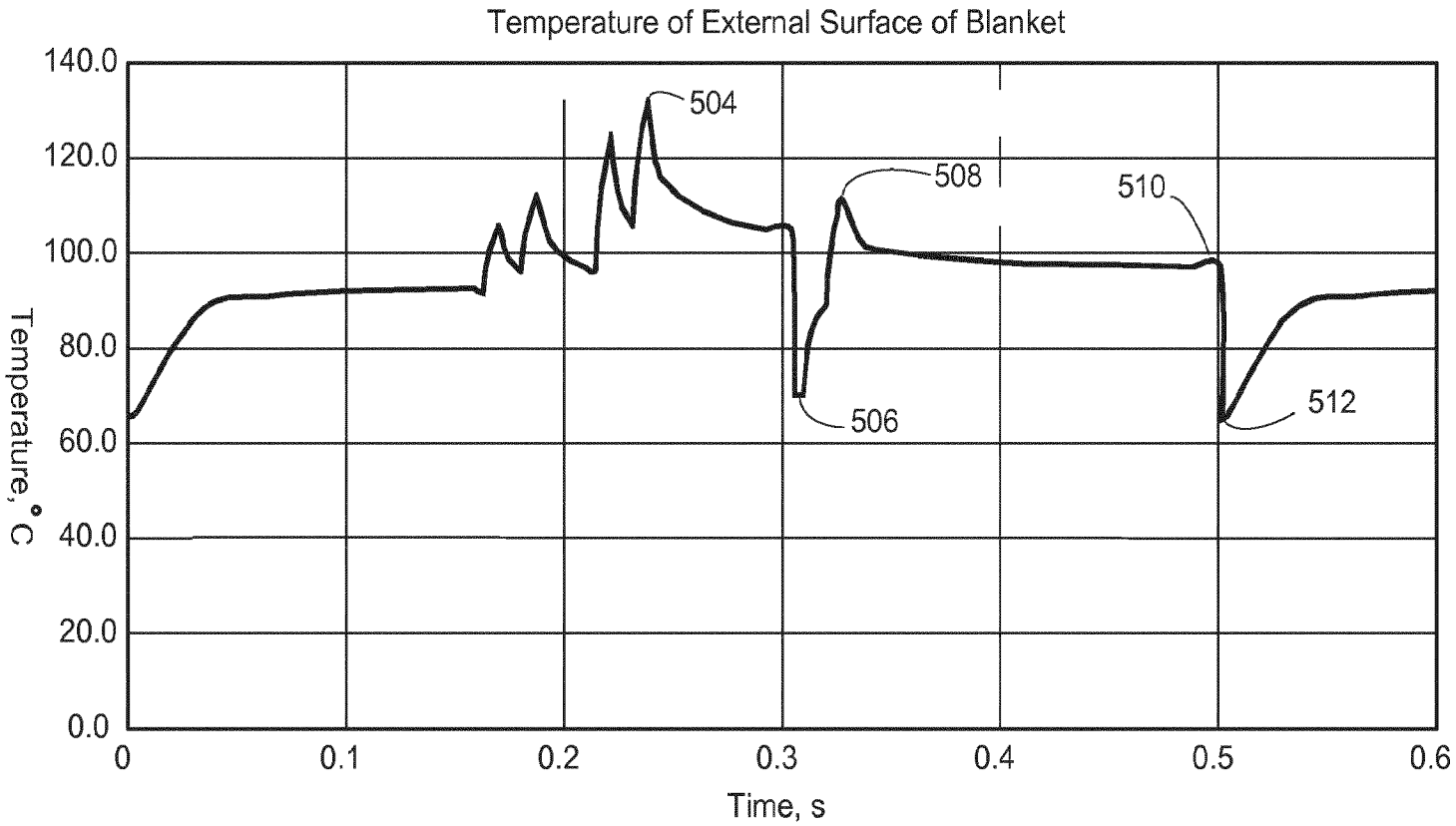
FIG. 5 is a graph of temperatures measured at an external surface of a blanket utilizing an example of a blanket memory artifact reduction system and method.

FIG. 5, in view of FIG. 4, is an example of temperatures measured at an external surface of a blanket utilizing the disclosed blanket memory artifact reduction system and method. In this example, a first transfer of ink is made from a rotating photoconductor drum 120 (FIG. 4) to a blanket 122 (FIG. 4) in contact with the photoconductor drum, the blanket situated upon a rotating blanket drum 124 (FIG. 4) and the first transfer occurring at a first arc 126 (FIG. 4) of a rotation path 128 (FIG. 4) for the blanket drum. In this particular example, a set of heating sources 204 (FIG. 4) located at a fourth arc 206 (FIG. 4) of the blanket drum rotation path heat the external surface of the blanket to a first peak temperature 504 of about 130° C.

Next a second transfer of ink is made from the blanket to a media situated upon a rotating media drum 130 (FIG. 4) at a third arc 136 (FIG. 4) of the blanket drum rotation path. As the media is at an ambient temperature, the temperature of the external surface of the blanket drops rapidly to a first low of approximately 70° C., represented by point 506.

Continuing at FIG. 5 in view of FIG. 4, while the energy at to the top of the heated blanket was quickly dissipated to about 70° C. (see point 506) due to contact with the ambient temperature media at the second arc 132, in this example the temperature of the external surface quickly rebounds to a second peak 508 of approximately 155° C. This rebound is due to the heating that has been directed to inside of the blanket diffusing to the external surface. In many situations, though, this temporary rebound of blanket external surface temperature is not enough to cause a complete evaporation of the carrier fluid remaining on the blanket after the blanket to media ink transfer.

To accelerate the evaporation of the remaining carrier fluid at the blanket, the disclosed examples provide for utilizing a laser emitter or other rapid heat source 134 (FIG. 4) located at the third arc of the blanket drum rotation path to raise the temperature of the blanket external surface to approximately 90° C. to 100° C. for a period of approximately 0.18 seconds. This post blanket to media heating is represented in FIG. 5 as the temperature period between point 508 (the beginning of heating by the first heat source) and point 510 (the switching off of the heating by the first heat source). In certain examples, a ventilation component 202 (FIG. 4) at, near, or adjacent to the third arc 136 may apply a ventilation air flow about 1 to 100 liters per second to further accelerate the carrier fluid evaporation.

At point 512, after termination of the heating by the first heating source 134 (FIG. 4), the blanket drum 124 (FIG. 4) has returned to first arc 126 (FIG. 4), where the blanket is ready to receive a new transfer of ink from the photoconductor as part of a next revolution of the blanket drum. The temperature of the external surface of the blanket at this point is about 65° C. In some examples, successive revolutions of the blanket drum may be to apply a distinct and separate color to the blanket and then to media to form a printed image upon the media.

In the foregoing discussion of FIGS. 1-4, engines 102-110 were described as combinations of hardware and programming. Engines 102-110 may be implemented in a number of fashions. Looking at FIG. 6 the programming may be processor executable instructions stored on a tangible memory resource 630 and the hardware may include a processing resource 640 for executing those instructions. Thus memory resource 630 can be said to store program instructions that when executed by processing resource 640 implement system 100 of FIGS. 1-4.

Memory resource 630 represents generally any number of memory components capable of storing instructions that can be executed by processing resource 640. Memory resource 630 is non-transitory in the sense that it does not encompass a transitory signal but instead is made up of a memory component or memory components to store the relevant instructions. Memory resource 630 may be implemented in a single device or distributed across devices. Likewise, processing resource 640 represents any number of processors capable of executing instructions stored by memory resource 630. Processing resource 640 may be integrated in a single device or distributed across devices. Further, memory resource 630 may be fully or partially integrated in the same device as processing resource 640, or it may be separate but accessible to that device and processing resource 640.

In one example, the program instructions can be part of an installation package that when installed can be executed by processing resource 640 to implement system 100. In this case, memory resource 630 may be a portable medium such as a CD, DVD, or flash drive or a memory maintained by a server from which the installation package can be downloaded and installed. In another example, the program instructions may be part of an application or applications already installed. Here, memory resource 630 can include integrated memory such as a hard drive, solid state drive, or the like.

Figure 6:
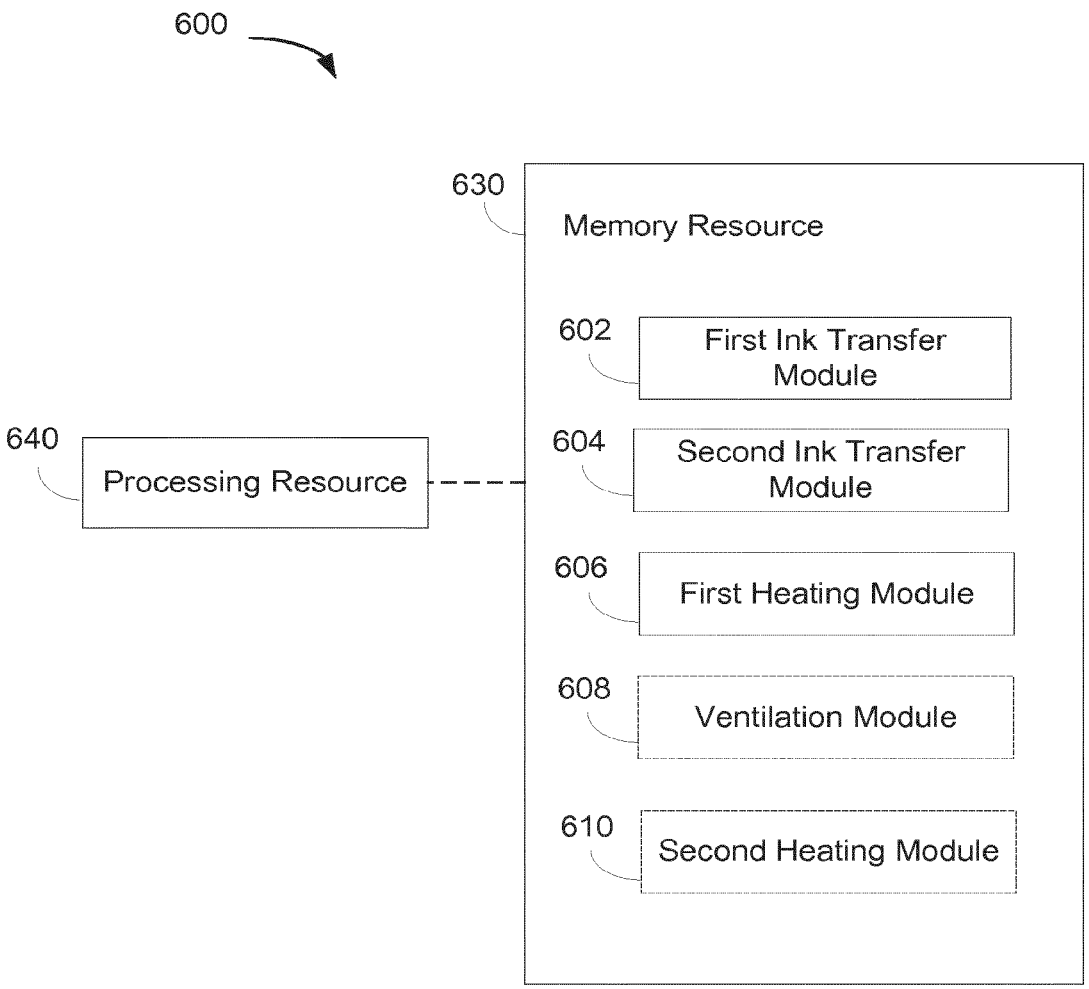
FIG. 6 is a block diagram depicting a memory resource and a processing resource to implement examples of a blanket memory artifact reduction system.

In FIG. 6, the executable program instructions stored in memory resource 630 are depicted as first ink transfer module 602, second ink transfer module 604, first heating module 606, ventilation module 608, and second heating module 610. First ink transfer module 602 represents program instructions that when executed by processing resource 640 may perform any of the functionalities described above in relation to first ink transfer engine 102 of FIGS. 1 and 3. Second ink transfer module 604 represents program instructions that when executed by processing resource 640 may perform any of the functionalities described above in relation to second ink transfer engine 104 of FIGS. 1 and 3. First heating module 606 represents program instructions that when executed by processing resource 640 may perform any of the functionalities described above in relation to first heating engine 106 of FIGS. 1 and 3. Ventilation module 608 represents program instructions that when executed by processing resource 640 may perform any of the functionalities described above in relation to ventilation engine 108 of FIGS. 2 and 4. Second heating module 610 represents program instructions that when executed by processing resource 640 may perform any of the functionalities described above in relation to second heating engine 110 of FIGS. 2 and 4.

Figure 7:
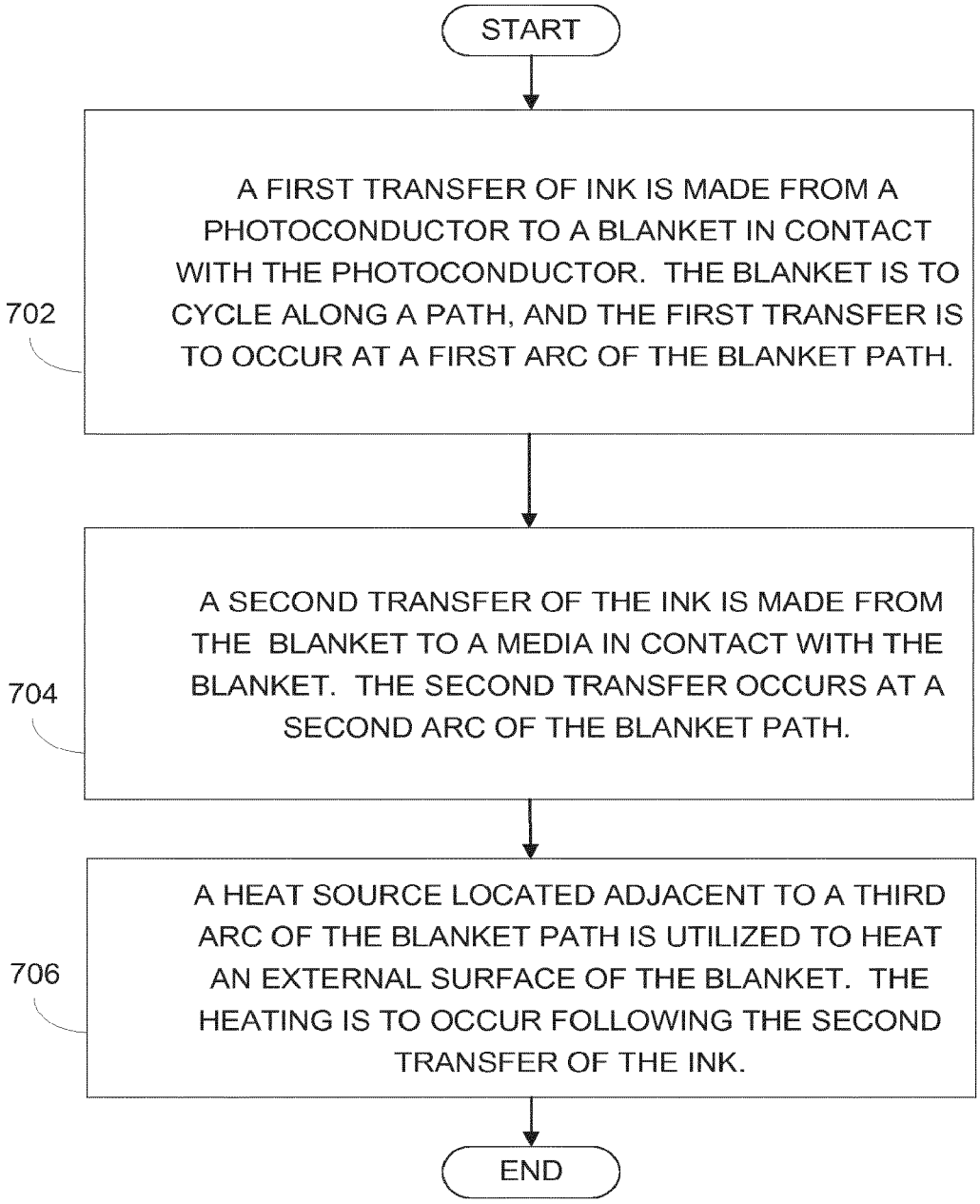
FIG. 7 is a flow diagram depicting implementation of an example of a method for reduction of blanket memory artifacts during printing.

FIG. 7 is a flow diagram of implementation of a method for reduction of blanket memory artifacts during printing. In discussing FIG. 7, reference may be made to the components depicted in FIGS. 1, 3, and 6. Such reference is made to provide contextual examples and not to limit the manner in which the method depicted by FIG. 7 may be implemented. A first transfer of ink is made from a photoconductor to a blanket in contact with the photoconductor. The blanket is to cycle along a path, and the first transfer is to occur at a first arc of the blanket path (block 702). Referring back to FIGS. 1, 3, and 6, first ink transfer engine 102 (FIGS. 1 and 3) or first ink transfer module 602 (FIG. 6), when executed by processing resource 640, may be responsible for implementing block 702.

A second transfer of the ink is made from the blanket to a media in contact with the blanket. The second transfer occurs at a second arc of the blanket path (block 704). Referring back to FIGS. 1, 3, and 6, second ink transfer engine 104 (FIGS. 1 and 3) or second ink transfer module 604 (FIG. 6), when executed by processing resource 640, may be responsible for implementing block 704.

A heat source located adjacent to a third arc of the blanket path is utilized to heat an external surface of the blanket. The heating is to occur following the second transfer of the ink (block 706). Referring back to FIGS. 1, 3, and 6, first heating engine 106 (FIGS. 1 and 3) or first heating module 606 (FIG. 6), when executed by processing resource 640, may be responsible for implementing block 706.

FIGS. 1-7 aid in depicting the architecture, functionality, and operation of various examples. In particular, FIGS. 1-4 and 6 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 7 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method for reduction of memory artifacts in a blanket during printing, comprising:

making a first transfer of ink from a photoconductor to a blanket in contact with the photoconductor, the blanket to cycle along a path, and the first transfer occurring at a first arc of the blanket path;

making a second transfer of the ink from the blanket to a media in contact with the blanket, the second transfer occurring at a second arc of the blanket path; and utilizing a heat source located adjacent to a third arc of the blanket path to heat an external surface of the blanket, the third arc of the blanket path spaced from the second arc of the blanket path, and the heating to occur at the third arc following the second transfer of the ink from the blanket to the media at the second arc before making another first transfer of ink from the photoconductor to the blanket at the first arc.

2. The method of claim 1, wherein the blanket is situated upon a belt.

3. The method of claim 1, wherein the photoconductor is a rotating photoconductor drum, wherein the blanket is situated upon a rotating blanket drum, and wherein the blanket path is a rotation path.

4. The method of claim 3, wherein ink transfer from the photoconductor drum to the blanket occurs at the first arc and ink transfer from the blanket to the media occurs at the second arc upon rotation of the blanket drum along the rotation path.

5. The method of claim 1, wherein the heating by the heat source is to heat the external surface of the blanket to about 90° C. to 160° C.

6. The method of claim 1, further comprising:

utilizing a second heat source located adjacent to a fourth arc of the blanket path to heat the external surface of the blanket, the heating by the second heat source to occur following the first transfer of ink from the photoconductor to the blanket before making the second transfer of the ink from the blanket to the media.

7. The method of claim 6, wherein the heating by the second heating source is to heat the external surface of the blanket to about 120° C. to 200° C.

8. The method of claim 1, wherein the media is to contact the blanket only at the second arc of the blanket path.

9. The method of claim 1, wherein the media is excluded from the third arc of the blanket path.

10. A system to reduce memory artifacts in a blanket during printing, comprising:

a blanket to be situated upon a rotatable blanket drum, the blanket to be in contact with a rotatable photoconductor drum and to receive a first transfer of ink from the photoconductor drum at a first arc of a rotation path for the blanket drum;

the blanket to be in contact with a media situated upon a rotatable media drum and to make a second transfer of the ink from the blanket to the media at a second arc of the rotation path; and a heat source to heat an external surface of the blanket at a third arc of the rotation path, the third arc of the rotation path spaced from the second arc of the rotation path, and the heat source to heat the external surface of the blanket at the third arc following the second transfer of the ink at the second arc before the blanket drum rotates to the first arc for a new first transfer of ink to the blanket from the photoconductor drum at the first arc.

11. The system of claim 10, wherein the first heat source is to heat the external surface of the blanket to about 90° C. to 160° C. after ink transfer from the blanket to the media.

12. The system of claim 10, wherein the heat source is a first heat source, and further comprising:

a set of second heat sources to heat the external surface of the blanket at a fourth arc of the rotation path, the set of second heat sources to heat the external surface of the blanket following the first transfer of the ink to the blanket from the photoconductor drum at the first arc before the second transfer of the ink from the blanket to the media at the second arc.

13. The system of claim 12, wherein the set of second heat sources are to heat the external surface of the blanket to about 120° C. to 200° C. before ink transfer from the blanket to the media.

14. The system of claim 10, wherein the media is to contact the blanket only at the second arc of the blanket path.

15. The system of claim 10, wherein the media is excluded from the third arc of the blanket path.

16. A memory resource storing instructions that when executed are to cause a processing resource to enable reduction of memory artifacts in a blanket during printing, comprising:

a first ink transfer module, that when executed causes the processor to initiate a first transfer of ink from a photoconductor to a cycling blanket in contact with the photoconductor, the first transfer occurring at a first arc of a path for the blanket;

a second ink transfer module, that when executed causes the processor to initiate a second transfer of the ink from the blanket to a media at a second arc of the blanket path; and a heating module, that when executed causes the processor to initiate a heat source located at a third arc of the blanket path to heat an external surface of the blanket, the third arc of the blanket path spaced from the second arc of the blanket path, and the heating to occur at the third arc following the second transfer of the ink at the second arc before the blanket returns to the first arc for a new first transfer of ink from the photoconductor to the blanket.

17. The memory resource of claim 16, wherein the heating is to heat the external surface of the blanket to about 90° C. to 160° C.

18. The memory resource of claim 16, further comprising:

a second heating module, that when executed causes the processor to initiate a set of second heating sources located at a fourth arc of the blanket path to heat the external surface of the blanket, the heating by the set of second heating sources to occur following the first transfer of the ink from the photoconductor to the blanket before the second transfer of the ink from the blanket to the media.

19. The memory resource of claim 18, wherein the heating by the set of second heating sources is to heat the external surface of the blanket to about 120° C. to 200° C.

20. The memory resource of claim 18, wherein the media is to contact the blanket only at the second arc of the blanket path, and the media is excluded from the third arc of the blanket path.

* * * * *